United States Patent [19]

Takagi et al.

[11] 4,006,721

[45] Feb. 8, 1977

[54] CONTROL APPARATUS FOR EXHAUST GAS RECIRCULATION SYSTEM

[75] Inventors: Yasuo Takagi; Kazuo Hioki; Syunichi Aoyama, all of Yokohama, Japan

[73] Assignee: Nissan Motor Co., Ltd., Japan

[22] Filed: May 30, 1975

[21] Appl. No.: 582,384

[30] Foreign Application Priority Data

June 24, 1974 Japan ..... 49-72081

[52] U.S. Cl. ..... 123/119 A

[51] Int. Cl.[2] ..... F02M 25/00

[58] Field of Search ..... 123/119 A

[56] References Cited

UNITED STATES PATENTS 3,868,934 3/1975 Mick ..... 123/119 A

FOREIGN PATENTS OR APPLICATIONS 1,802,315 6/1970 Germany ..... 123/119 A

*Primary Examiner*—Ronald H. Lazarus

*Attorney, Agent, or Firm*—Robert E. Burns; Emmanuel J. Lobato; Bruce L. Adams

[57] ABSTRACT

A control apparatus for a vacuum operated device comprising a first flexible diaphragm responsive to a vacuum input, a second flexible diaphragm responsive to a vacuum output present in a vacuum chamber, a control valve associated with said second flexible diaphragm for controlling the vacuum output in said chamber, and a control arm connected between said first and second diaphragms and rotatable about a fulcrum, the movement of said first flexible diaphragm being transmitted through said control arm to said second flexible diaphragm, whereby said control valve is actuated to control the vacuum output in said vacuum chamber.

10 Claims, 4 Drawing Figures

CONTROL APPARATUS FOR EXHAUST GAS RECIRCULATION SYSTEM

The present invention relates in general to control apparatus for a vacuum operated device and, more particularly, to the improvement over a vacuum regulator for controlling an exhaust gas recirculating valve of an exhaust system of an internal combustion engine.

It is well known in the art that the emission of nitrogen oxides by an internal combustion engine can be substantially reduced or eliminated by recirculating more or less of the engine exhaust gases back into the intake manifold of the engine. To maximize performance efficiency of the engine, however, it is desirable to recirculate a volume of engine exhaust gas at a constant ratio with respect to the amount of intake air to be sucked into the engine. To this end, it has heretofore been proposed to control an exhaust gas recirculating valve by using venturi vacuum which is a factor of the amount of intake air. The absolute pressure of the venturi vacuum is relatively low with a result that the vacuum regulator must be massive in size so as to provide a sufficient control for the exhaust gas recirculating valve. Another drawback encountered with this prior art proposal is that the amount of exhaust gas recirculation will vary in dependence on the variations in fluctuations of venturi vacuum and, thus, the amount of exhaust gas recirculation can not be maintained at a constant ratio with respect to the amount of intake air. If the recirculation ratio of the engine exhaust gases varies in accordance with varying operating conditions of the engine, the operating characteristics of the internal combustion engine lack of stability.

It is, therefore, an important object of the present invention to provide an improved control apparatus for controlling a vacuum operated device such as an engine exhaust gas recirculating valve.

It is another object of the present invention to provide a vacuum regulator for controlling an exhaust gas recirculating valve for an exhaust system of an internal combustion engine.

It is another object of the present invention to provide a vacuum regulator which is simple in construction and reliable in operation.

It is still another object of the present invention to provide a vacuum regulator adapted to control exhaust gas recirculating valve so as to cause the same to recirculate engine exhaust gases at a selected constant ratio throughout varying operating conditions of an internal combustion engine.

These and other objects, features and advantages of the present invention will become more apparent from the following description when taken in conjunction with the accompanying drawings, in which.

Figure 1:
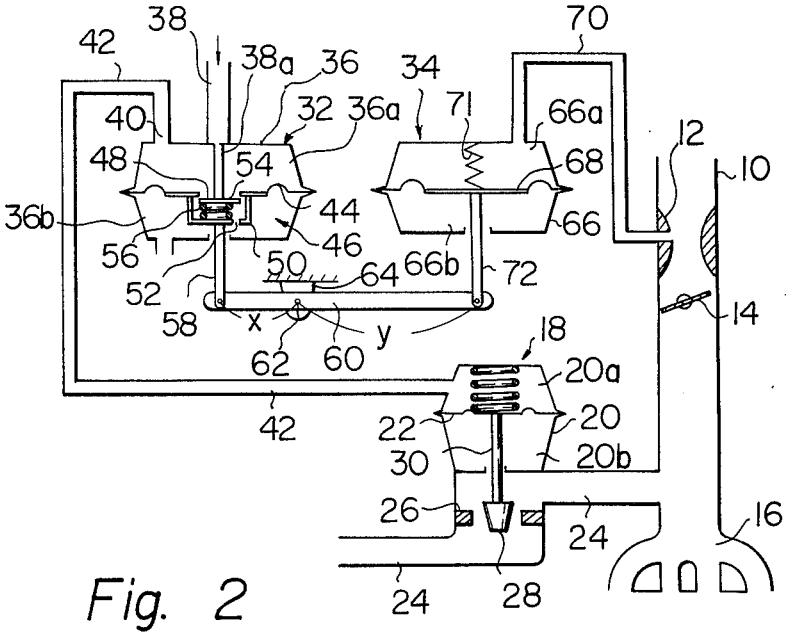
FIG. 1 is a schematic view of a preferred embodiment of a control apparatus according to the present invention.

Referring now to FIG. 1 of the drawings, there is schematically shown a control system for controlling the recirculation of exhaust gases through an automotive internal combustion engine, only certain parts of which engine are shown. The engine includes a carburetor having an air intake 10 incorporating the usual venturi throat 12 and throttle valve 14. The engine also includes a conventional intake manifold 16 and an exhaust manifold (not shown). In the present instance, an exhaust gas recirculation control valve 18 is arranged to control the flow of exhaust gas from the exhaust manifold into the intake manifold for recirculation through the engine so as to reduce or eliminate nitrogen oxide emissions.

The exhaust gas recirculation control valve 18 comprises a body 20 in whch a flexible diaphragm 22 is disposed. The flexible diaphragm 22 divides the body 20 into a vacuum chamber **20*a* and an atmospheric chamber 20*b* which is vented to the atmosphere though not shown. The body 20 is mounted on an exhaust gas recirculation pipe 24 which is formed with a valve seat 26. A valve member 28 is connected through a valve stem 30 to the flexible diaphragm 22, and is movable into and out of engagement with the valve seat 26 to control the flow of the exhaust gas recirculation. The exhaust gas recirculation control valve 18 thus arranged is controlled by a vacuum present in the vacuum chamber 20*a*.**

The degree of vacuum present in the vacuum chamber **20*a* is controlled by apparatus comprised of a vacuum regulator 32 and a vacuum motor 34 for actuating the vacuum regulator 32. The vacuum source for the regulator 32 is obtained through an input connected to the intake manifold 16 and this vacuum source is regulated to provide a vacuum output which is connected to the chamber 20*a* of the exhaust gas recirculation control valve 18 for operating the same. The vacuum regulator 32 is controlled in accordance with the vacuum at the venturi 12 by the motor 34 so as to provide a vacuum output to the valve 18** which is an amplification of the venturi vacuum.

As shown, the vacuum regulator 32 comprises a body 36 having an inlet 38 and an outlet 40. The inlet 38 has a projecting end **38*a* extending into the body 36 and connected to the intake manifold 16 of the engine to receive therefrom intake manifold vacuum. The outlet 40 is in communication through a conduit 42 with the vacuum chamber 20*a* of the exhaust gas recirculation control valve 18 to supply a vacuum output thereinto. A flexible diaphragm 44 is disposed in the body 32 to define a vacuum chamber 36*a* and an atmospheric chamber 36*b*. A pressure control valve 46 is associated with the flexible diaphragm 44, which is formed with a valve opening 48. The pressure control valve 46 includes a casing 50 fixed to the flexible diaphragm 44. The casing 50 is formed with an air bleed 52 communicating with the atmospheric chamber 36*b* vented to the atmosphere. A flat valve member 54 is operatively disposed in the casing 50 and is urged by a biasing means such as a compression spring 56 in a direction to close the end of the inlet 38. It should be noted that the valve member 54 normally closes the valve opening 48 defined by the flexible diaphragm 44 to prevent the atmospheric pressure from being admitted to the vacuum chamber 36*a*. The opening degree of the valve opening 48 is thus controlled by the valve member 54 by varying the position of the flexible diaphragm 44. The position of the flexible diaphragm 44 is controlled by an actuating rod 58 which is pivotally connected to one end of a control arm 60. The control arm 60 is connected at its intermediate portion to a fulcrum 62** provided on a bracket 64, and is actuated by the vacuum motor 34.

The vacuum motor 34 comprises a body 66 incorporating therein a flexible diaphragm 68 defining a vacuum chamber 66*a* and an atmospheric chamber 66*b*. The vacuum chamber 66*a* communicates through a conduit 70 with the venturi 12 of the carburetor 10. The atmospheric chamber 66*b* is vented to the atmosphere, though not shown. A biasing means 71 such as a compression spring is disposed in the vacuum chamber 66*a* to urge the flexible diaphragm 68 downward as viewed in FIG. 1. An actuating rod 72 is connected to and movable with the flexible diaphragm 68, and is also connected to another end of the control arm 60 for actuating the same. It should be noted that the distance $x$ between the one end of the arm 60 and its fulcrum 62 is preferably selected to be smaller than $y$ between another end of the arm 60 and its fulcrum 62 because the intake manifold vacuum acting on the flexible diaphragm 44 is larger than the venturi vacuum acting on the flexible diaphragm 68. It should also be noted that the effective sectional area of the flexible diaphragm 68 may be equal to that of the diaphragm 44 but is preferably determined to be larger than that of the diaphragm 44.

When, in operation, a venturi vacuum is supplied through the conduit 70 into the vacuum chamber 66*a* of the vacuum motor 34, the venturi vacuum acts on the flexible diaphragm 68 to cause the same to move upward against the action of the biasing means 71 so that the actuating rod 72 is moved upward. This causes the control arm 60 to rotate counterclockwise about the fulcrum 62 with a result that the actuating rod 58 and accordingly the diaphragm 44 are moved downward by the action of the control arm 60. In this instance, the valve member 54 is moved to a position to open the projecting end 38*a* of the inlet 38 while closing the valve opening 48 by the action of the biasing means 56. Thus, the intake manifold vacuum is admitted to the vacuum chamber 36*a* and the vacuum pressure present in this chamber 36*a* increases rapidly. The vacuum in the chamber 36*a* acts on the flexible diaphragm 44, which is consequently moved upward against the action of the actuating rod 58 until the force developed by the vacuum acting on the diaphragm 44 balances with the force of the actuating rod 58. In this condition, the projecting end of the inlet 38 is closed again by the valve member 54. If, in this instance, the vacuum in the chamber 36*a* is at extremely high level, then the diaphragm 44 is further moved upward so that the valve opening 48 is opened by the valve member 54 engaging with the end of the inlet 38 thereby permitting the flow of atmospheric pressure into the chamber 36*a* for regulating the vacuum in the chamber 36*a* to an appropriate value.

Assuming now that the flexible diaphragm 44 of the vacuum regulator 32 is held at its balanced position, the following relation is obtained:

$$(Vv \cdot s_1 + Fo) \cdot y = Vs \cdot S_2 \cdot x \qquad (1)$$

Accordingly, $$Vs = Vv \left( \frac{S_1}{S_2} \cdot \frac{y}{x} \right) + \frac{Fo}{S_2} \cdot \frac{y}{x} \qquad (2)$$

where Vv is a vacuum input (venturi vacuum), Vs is a vacuum output, $S_1$ is the effective sectional area of the diaphragm 68, $S_2$ is the effective sectional area of the diaphragm 44, Fo is the force of the compression spring 71, $x$ is the distance between the one end of the arm 60 and its fulcrum 62, and $y$ is the distance between another end of the arm 60 and its fulcrum 62.

It will be seen from the above equation that the vacuum output Vs is an amplification of the venturi vacuum multiplied by the product of the ratio $S_1/S_2$ and the ratio $y/x$. It will thus be understood that the amplification ratio of the venturi vacuum is readily selected by varying the ratio $S_1/S_2$ or the ratio $y/x$.

If the venturi vacuum present in the vacuum chamber 66*a* of the vacuum motor 34 decreases, then the force developed by the venturi vacuum acting on the diaphragm 68 is decreased. Under this circumstance, the force delivered to the actuating rod 58 through the control arm 60 is weak so that the diaphragm 44 of the vacuum regulator 32 is moved upward by the force developed by the vacuum output present in the chamber 36*a*. Accordingly, the valve opening of the diaphragm 44 is opened by the valve member 54 of the control valve 46 while the end of the inlet is closed by the valve member 54. Thus, the atmospheric pressure is admitted to the vacuum chamber 36*a* and, therefore, the vacuum output present in the chamber decreases. As the vacuum output decreases, the force developed by the vacuum output acting on the diaphragm 44 also decreases and balances with the force transmitted to the actuating rod 58 in a position where the control valve 46 closes the valve opening 48. The vacuum output thus regulated is delivered through the conduit 42 to the exhaust gas recirculation control valve 18 for actuating the same so as to vary the flow of exhaust gas recirculation in dependence on the amount of intake air passing through the carburetor 10.

Figure 2:
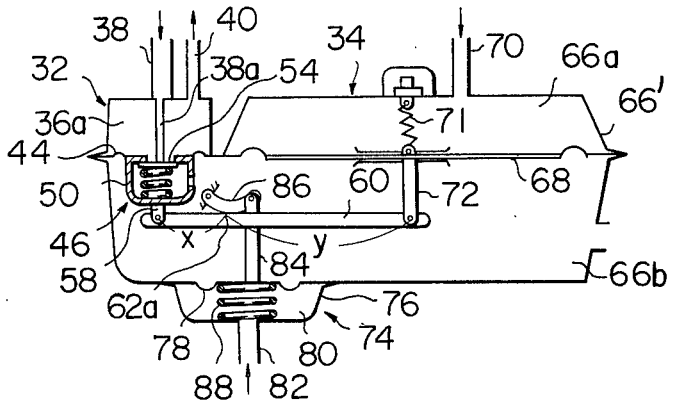
FIG. 2 is a schematic view of another embodiment of a control apparatus according to the present invention.

As is well known, the amount of exhaust gas recirculation through the conduit 24 is also dependent on the pressure difference between the valve seat 26 in addition to the opening degree of the valve seat 26. When the intake manifold vacuum is at high level, the pressure difference mentioned above is great. In order to maintain the flow rate of exhaust gas recirculation constant, it is desirable to decrease the opening degree of the valve seat 26 in dependence on the level of the intake manifold vacuum. A control apparatus to perform this concept is schematically shown in FIG. 2, in which like or corresponding component parts are designated by the same reference numerals as those used in FIG. 1. In this illustrated embodiment, the diaphragms 68 and 44 are provided in a unitary body 66', in which actuating rods 58 and 72, the control arm 60 and the control valve 46 are also incorporated to provide a compact construction. As shown, the control apparatus is further provided with a compensating vacuum motor 74 having a body 76 mounted on the unitary casing 66'. The compensating vacuum motor 74 includes a flexible diaphragm 78 defining a vacuum chamber 80 which is in communication with the intake manifold 16 by means of a conduit 82. A control rod 84 is connected to and movable with the diaphragm 78. This control rod 84 is connected at its one end to one end of a movable cam 86 serving as a shiftable fulcrum. With this arrangement, as the intake manifold vacuum present in the vacuum chamber 80 increases, the flexible diaphragm 78 is moved downward against the action of the compression spring 88 disposed in the chamber 80, thereby pulling the control rod 84 downward so that the fulcrum 62*a* provided by the cam 86 is shifted rightward as viewed in FIG. 2. Thus, the ratio $y/x$ is decreased.

Consequently, the amplification ratio of the vacuum output is decreased in proportion to the increase in the intake manifold vacuum. In other words, if the intake manifold vacuum increases, the vacuum output present in the chamber 20 of the exhaust gas recirculation control valve 18 is decreased for thereby decreasing the opening degree of the valve seat 26 to maintain the ratio of the exhaust gas recirculation at constant valve.

Figure 3:
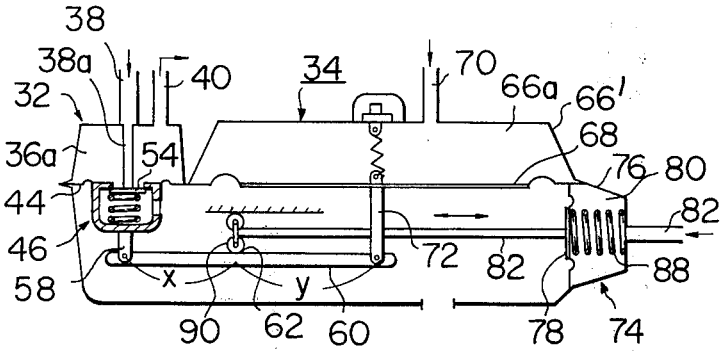
FIG. 3 is a view illustrating a modified form of the apparatus shown in FIG. 2.

A modified form of the control apparatus shown in FIG. 2 is illustrated in FIG. 3, in which like or corresponding component parts are designated by the same reference numerals as those used in FIG. 2. A modification of FIG. 3 differs from the illustrated embodiment shown in FIG. 2 in that the control rod 84 of the compensating vacuum motor 74 is movable in parallel to the control arm 60 and a roller 90 is provided at the end of the control rod 84 whereby the fulcrum 62 is shifted to a selected position in dependence on the intake manifold vacuum present in the chamber 80 of the compensating vacuum motor 74.

Figure 4:
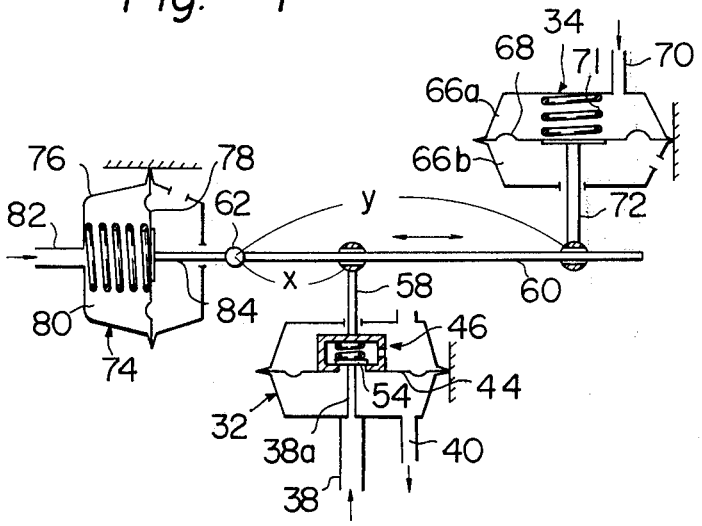
FIG. 4 is a view illustrating another modified form of the apparatus shown in FIG. 2.

Another modified form of the control apparatus shown in FIg. 2 is illustrated in FIG. 4, in which one end of the control arm 60 is pivotally connected to and movable with the control rod 84 of the compensating vacuum motor 74 and the ends of the actuating rods 58 and 72 of the vacuum regulator 32 and the vacuum motor 34 are slidably connected thereto. With this arrangement, the ratio $y/x$ is varied in dependence on the intake manifold vacuum present in the chamber 80 to maintain the exhaust gas recirculation ratio at constant value.

It will now be understood from the foregoing description that the control apparatus according to the present invention control the vacuum output for actuating the exhaust gas recirculation control valve in a satisfactory fashion.

It will also be noted that the amplification ratio of the venturi vacuum can be varied by changing the ratio $S_1/S_2$ of the effective sectional areas of the diaphragms 68 and 44 or by changing the ratio $y/x$ of the control arm 60.

It will further be noticed that the vacuum output for actuating the vacuum operated device is adjusted in dependence on the intake manifold vacuum and, therefore, the flow rate of the exhaust gas recirculation can be maintained at a constant value irrespective of the variations in the intake manifold vacuum of the engine throughout the various operating conditions of the engine.

What is claimed is:

1. In an internal combustion engine having a carburetor provided with a venturi and an intake manifold, a control apparatus for an exhaust gas recirculation control valve comprising a first flexible diaphragm responsive to a venturi vacuum in said carburetor, a second flexible diaphragm defining a vacuum chamber and responsive to vacuum output present therein, said second flexible diaphragm having a valve opening providing communication between said vacuum chamber and an atmosphere, a control valve cooperating with said second flexible diaphragm and opening and closing said valve opening, and a control arm connected between said first and second flexible diaphragms and rotatable about a fulcrum, said control arm transmitting movements of said first flexible diaphragm to said second flexible diaphragm, whereby said second flexible diaphragm is moved in response to the movements of said second flexible diaphragm and the vacuum output in said vacuum chamber for controlling said control valve to open and close said valve opening for thereby regulating the vacuum output in said vacuum chamber, and regulated vacuum output being fed to said exhaust gas recirculation control valve to actuate the same.

2. A control apparatus according to claim 1, in which said vacuum chamber has an inlet communicating with the intake manifold of the engine, said inlet projecting into said vacuum chamber and facing a valve member of said control valve so that said inlet is opened and closed by said control valve, and an outlet communicating with said exhaust gas recirculation control valve to supply the vacuum output thereinto.

3. A control apparatus according to claim 1, in which the fulcrum of said control arm has a fixed position.

4. A control apparatus according to claim 1, in which said first flexible diaphragm is disposed in a first body communicating with said venturi of said carburetor.

5. A control apparatus according to claim 1, in which said second flexible diaphragm is disposed in a second body in which said vacuum chamber is formed.

6. A control apparatus according to claim 1, in which said first and second flexible diaphragms, control valve and control arm are incorporated in a unitary casing.

7. A control apparatus according to claim 1, further comprising a third flexible diaphragm responsive to an intake manifold vacuum and movable to different positions in dependence thereon for shifting the fulcrum of said control arm to various positions for thereby compensating the vacuum output in said vacuum chamber in dependence on the intake manifold vacuum.

8. A control apparatus according to claim 7, in which the fulcrum of said control arm is provided by a cam member connected to said third flexible diaphragm, said cam member being engageable with said control arm at different positions in dependence on the position of said third flexible diaphragm.

9. A control apparatus according to claim 7, in which the fulcrum of said control arm is provided by a roller which is connected to said third flexible diaphragm, said roller being engageable with said control arm at different positions in dependence on the position of said third flexible diaphragm.

10. A control apparatus according to claim 7, in which said third flexible diaphragm is pivotally connected to one end of said control arm, and further comprising a first actuating rod connected to said first flexible diaphragm, and a second actuating rod connected to said second flexible diaphragm, said first and second actuating rods having ends slidably carried on said control arm.

* * * * *